US010676702B2

(12) United States Patent
Denny et al.

(10) Patent No.: US 10,676,702 B2
(45) **Date of Patent: *Jun. 9, 2020**

(54) DRYER-ACTIVATED FABRIC CONDITIONING PRODUCTS HAVING FRANGIBLE BOUNDARIES AND METHODS

(71) Applicant: The Procter & Gamble Company, Cincinnati, OH (US)

(72) Inventors: Jeffrey Wayne Denny, Fairfield Township, OH (US); Signe Christina Larson, Liberty Township, OH (US); Jacob (Karun) Jayakaran, Greenhills, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/271,043

(22) Filed: Feb. 8, 2019

(65) Prior Publication Data

US 2019/0169553 A1 Jun. 6, 2019

Related U.S. Application Data

(63) Continuation of application No. 15/088,663, filed on Apr. 1, 2016, now Pat. No. 10,221,380.

(51) Int. Cl.

| | |
|---|---|
| ***C11D 17/04*** | (2006.01) |
| ***C11D 3/50*** | (2006.01) |
| *D06F 58/02* | (2006.01) |

(52) U.S. Cl.

CPC ..... *C11D 17/047* (2013.01); *C11D 3/50* (2013.01); *D06F 58/02* (2013.01)

(58) Field of Classification Search

CPC ..... C11D 17/047
USPC ..... 428/44
See application file for complete search history.

(56) References Cited

U.S. PATENT DOCUMENTS

| | | | |
|---|---|---|---|
| 3,224,632 | A | 12/1965 | Marcalus |
| 3,239,097 | A | 3/1966 | Bates et al. |
| 3,462,043 | A | 8/1969 | Frick |
| 3,895,128 | A | 7/1975 | Gaiser |
| 3,944,694 | A | 3/1976 | McQueary |
| 4,012,540 | A | 3/1977 | McQueary |

(Continued)

FOREIGN PATENT DOCUMENTS

| | | | |
|---|---|---|---|
| CA | 1 121 111 | A | 10/1978 |
| EP | 0 302 382 | A1 | 2/1989 |

OTHER PUBLICATIONS

365 Everyday Value Fabric Softening Sheets, Lavender scent, 1 Box, 80 sheets, purchased at Whole Foods Market in Cincinnati, Ohio on Apr. 7, 2016. Description on box: Fabric softening dryer sheets.

(Continued)

*Primary Examiner* — Brent T O'Hern
(74) *Attorney, Agent, or Firm* — Gary J. Foose

(57) ABSTRACT

A dryer-activated product having a plurality of discrete dryer sheets having a non-woven fibrous substrate, each dryer sheet having at least a first portion, a second portion, and a frangible boundary between the first portion and the second portion, and each of the first portion and the second portion having at least about 0.35 grams of a fabric conditioning active composition.

9 Claims, 5 Drawing Sheets

(56) References Cited

U.S. PATENT DOCUMENTS

| | | | | |
|---|---|---|---|---|
| 4,022,938 | A * | 5/1977 | Zaki | C11D 1/835 427/242 |
| 4,110,498 | A | 8/1978 | Benjamin et al. | |
| 4,143,762 | A | 3/1979 | Spiegelberg | |
| 4,181,225 | A | 1/1980 | Spiegelberg | |
| 4,199,464 | A | 4/1980 | Cambre | |
| 4,259,373 | A | 3/1981 | Demessemaekers et al. | |
| 4,663,198 | A | 5/1987 | Norris | |
| 4,824,582 | A | 4/1989 | Nayar | |
| 5,208,089 | A | 5/1993 | Norris | |
| 5,305,881 | A | 4/1994 | Caldwell et al. | |
| 5,310,057 | A | 5/1994 | Caldwell et al. | |
| 5,332,118 | A | 7/1994 | Muckenfuhs | |
| 5,425,887 | A * | 6/1995 | Lam | C11D 3/001 442/102 |
| 5,470,492 | A | 11/1995 | Childs et al. | |
| 5,476,599 | A | 12/1995 | Rusche et al. | |
| 5,500,137 | A | 3/1996 | Bacon et al. | |
| 5,503,756 | A | 4/1996 | Corona, III et al. | |
| 5,524,759 | A | 6/1996 | Herzberg et al. | |
| 5,577,612 | A | 11/1996 | Chesson et al. | |
| 5,883,069 | A | 3/1999 | Childs et al. | |
| 5,929,026 | A | 7/1999 | Childs et al. | |
| 6,045,002 | A | 4/2000 | Wierschke | |
| 6,165,953 | A | 12/2000 | Gardlik et al. | |
| 6,168,848 | B1 | 1/2001 | Heath | |
| 7,196,049 | B2 | 3/2007 | Brain et al. | |
| 7,659,239 | B2 | 2/2010 | King et al. | |
| 7,745,386 | B2 | 6/2010 | King et al. | |
| 9,273,274 | B2 | 3/2016 | Aouad et al. | |
| 10,221,380 | B2 * | 3/2019 | Denny | C11D 3/50 |
| 2001/0002496 | A1 | 6/2001 | Reynolds | |
| 2005/0109827 | A1 | 5/2005 | Martin | |
| 2005/0209116 | A1 | 9/2005 | Edelman et al. | |
| 2007/0062967 | A1 * | 3/2007 | Zaidman | A47K 10/421 221/48 |
| 2009/0127149 | A1 | 5/2009 | Samarcq et al. | |
| 2010/0251486 | A1 * | 10/2010 | Yu | C11D 3/001 8/137 |
| 2011/0167568 | A1 | 7/2011 | Littig et al. | |

OTHER PUBLICATIONS

Sun & Earth Natural Fabric Softener Sheets, Unscented, 1 Box, 80 sheets, purchased at Whole Foods Market in Cincinnati, Ohio on Apr. 7, 2016. Description on box: Natural fabric softener sheets made with a vegetable derived softening agent and a neutralizing odor control.

Mrs. Meyer*s Clean Day Dryer Sheets, Lavender scent, 1 Box, 80 sheets, purchased at Whole Foods Market in Cincinnati, Ohio on Apr. 7, 2016. Description on box: Mrs. Meyer's paper dryer sheets are compostable and recyclable. Product ingredients are at least 98% naturally derived.

Better Life Naturally Static-Stomping Dryer Sheets, Lavender Grapefruit scent, 1 Box, 80 sheets, purchased at Whole Foods Market in Cincinnati, Ohio on Apr. 7, 2016. Description on box: Vegetable-derived softening agents, unbleached paper, 100% natural scent.

Method Dryer Sheets, Beach Sage scent, 1 Box, 80 sheets, purchased at Target in Cincinnati, Ohio on Apr. 8, 2016. Description on box: Compostable paper sheets.

International Search Report for International Application Serial No. PCT/US2017/025337, dated Jun. 29, 2017, 14 pages.

Non-Final Office Action for U.S. Appl. No. 15/088,663, dated May 3, 2018, 16 pages.

Final Office Action for U.S. Appl. No. 15/088,663, dated Aug. 30, 2018, 6 pages.

Notice of Allowance for U.S. Appl. No. 15/088,663, dated Nov. 15, 2018, 9 pages.

* cited by examiner

DRYER-ACTIVATED FABRIC CONDITIONING PRODUCTS HAVING FRANGIBLE BOUNDARIES AND METHODS

FIELD OF THE INVENTION

Products, and methods of using the same, for conditioning fabric in an automatic laundry drying machine.

BACKGROUND OF THE INVENTION

Consumers are continually expressing the desire to have soft and fresh smelling clothing that is free of static cling. To obtain such benefits, in laundering it is common for consumers to place dryer sheets along with their clothing in their automatic laundry drying machines. Dryer sheets typically reach most pieces of fabric in the load as they tumble along with the clothing as the automatic laundry drying machine drum rotates. Generally, conventional dryer sheets are made up of non-woven fibrous substrates which are impregnated or coated with fabric enhancers such as a fabric conditioning active composition, cationic softening agents, antistatic agents, dispersing agents and perfumes. The fabric enhancers are applied to the non-woven fibrous substrate and then dried in an oven or run over chilled rollers so that the dryer sheet is "dry" when ready for use. These dryer sheets may be readily placed in the automatic laundry drying machine with the consumer's clothing. During the drying process, the fabric enhancers impregnated or coated on the dryer sheet are released and transferred from the dryer sheet to the clothing, either directly from the dryer sheet to the clothing or indirectly by first transferring from the dryer sheet onto to the drum and then from the drum onto the clothing. Examples of dryer sheets may include but are not limited to dryer sheets such as those sold under the tradename BOUNCE DRYER SHEETS manufactured and sold by The Procter & Gamble Company, Cincinnati, Ohio, USA and SNUGGLE DRYER SHEETS manufactured and sold by The Sun Products Corporation, Wilton, Conn., USA. Dryer sheets have generally been provided to consumers as individual folded sheets stored in recloseable cartons.

To decrease the time consumers spend laundering their clothing, through the years manufacturers have steadily increased the size of the drum in automatic laundry drying machines to hold a greater capacity of clothing. These larger sized drums reduce the number of loads of laundry a consumer has to wash and dry. A problem arises when consumers visually perceive the quantity of clothing placed in the smaller sized drums as the same size load as the quantity of clothing placed in these new larger sized drums. This inaccurate visual perception can lead consumers to continue the habit of placing only one dryer sheet in the automatic laundry drying machine with the clothing. In doing so, each of the individual pieces of clothing in these larger sized loads has less fabric enhancer being transferred to its fabric because there is more clothing but still the same amount of fabric enhancers.

To attempt to solve this problem of underdosage of fabric enhancers, a wax bar can be glued to the automatic laundry drying machine drum to release fabric enhancers with the heat of the drying cycle. However, these wax bars could lead to pieces of wax broken off during the drying cycle being found amongst the clothing and since the bar is affixed to one point of the drum, the bar might not touch every piece of clothing. Manufacturers have further tried to resolve the problem of underdosage by creating small balls that are placed with the clothing and move around as the drum rotates. However, these dryer balls typically do not contain fabric enhancers but are more so used to reduce static cling. Alternatively, manufacturers have created liquid fabric conditioning sprays that consumers can spray onto their wet clothing before beginning the drying cycle. When using the spray, consumers may not easily judge whether they are underdosing. The composition might also only affix to one portion of the clothing and not transfer to the remainder of the clothing during the drying cycle. As another option, manufacturers have included on their dryer sheet carton instructions to use more than one sheet for better results. However, consumers may not always notice this instruction and might continue to only use one sheet even while drying a large sized load.

In view of the above, there is a continuing unaddressed need for a product and method of using such product to deliver an effective amount of fabric conditioning active composition to the clothing fabrics in a load of laundry in an automatic laundry drying machine with minimal change in consumer habits.

SUMMARY OF THE INVENTION

A dryer-activated product comprising a plurality of discrete dryer sheets, the dryer sheets comprising a non-woven fibrous substrate, wherein each dryer sheet is folded along a first fold line and along a second fold line substantially parallel to the first fold line to have a z-fold, wherein each dryer sheet is folded along a third fold line substantially perpendicular to the first fold line to have a c-fold, each dryer sheet having at least a first portion, a second portion, and a frangible boundary between the first portion and the second portion, wherein each of the first portion and the second portion comprises at least about 0.35 grams of a fabric conditioning active composition. A process for conditioning fabrics comprising the steps of grasping a discrete dryer sheet having a frangible boundary, tearing the dryer sheet along the frangible boundary into a first portion and a second portion, placing one or both of the first portion and second portion inside an automatic laundry drying machine containing articles of clothing, and turning on the automatic laundry machine.

DETAILED DESCRIPTION OF THE INVENTION

Figure 1:
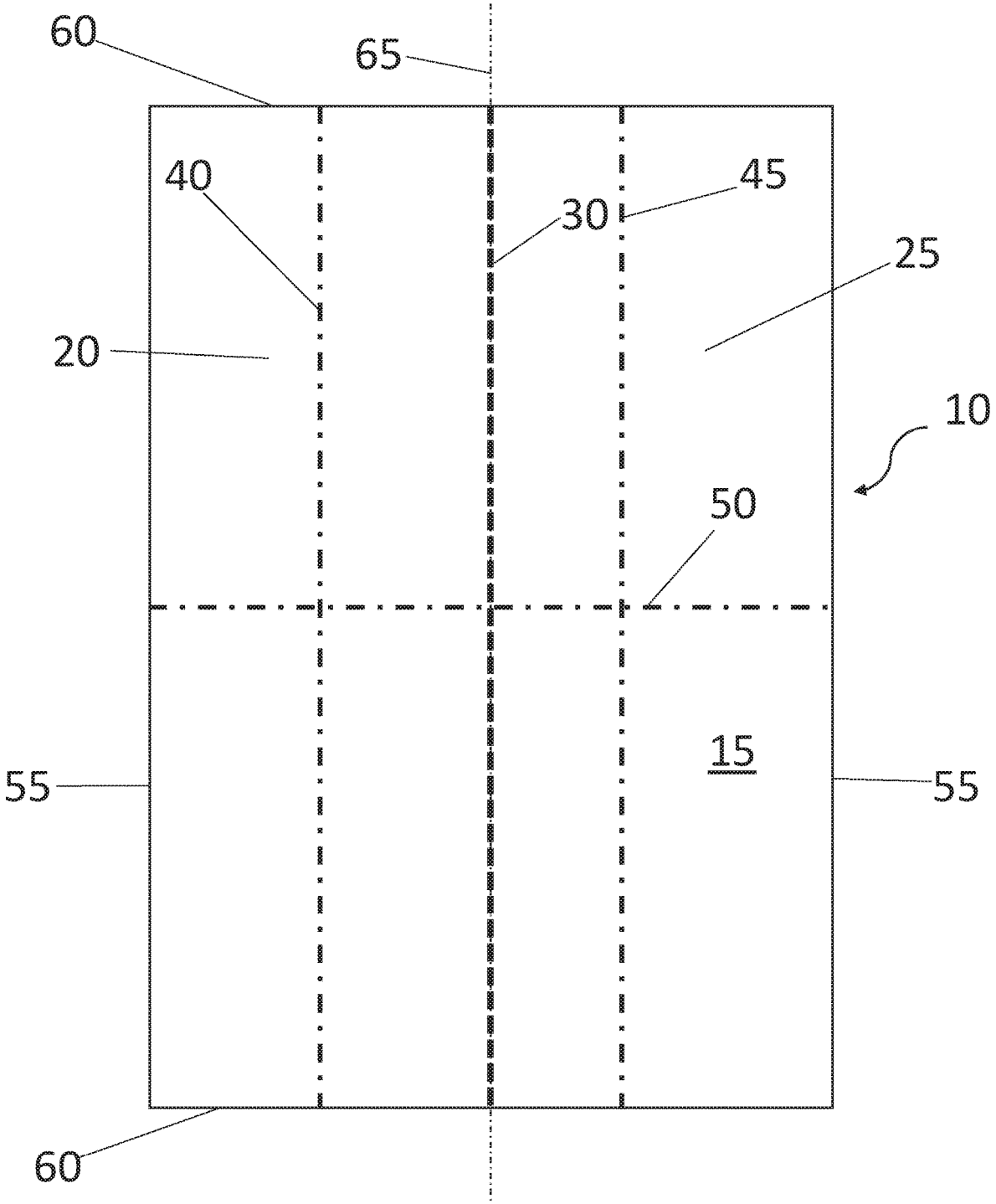
FIG. 1 is a drawing of an unfolded dryer sheet having fold lines.

FIG. 1 is a drawing of an unfolded dryer sheet 10 having fold lines. The dryer sheet 10 may comprise a non-woven fibrous substrate 15. The dryer sheet 10 may have at least a first portion 20, a second portion 25, and a frangible boundary 30 between the first portion 20 and second portion 25. The frangible boundary 30 is indicated in FIG. 1 by a heavy dashed line. The frangible boundary 30 may comprise a plurality of perforations. The dryer sheet 10 may be substantially rectangularly shaped. The dryer sheet 10 may have an axis 65. The dryer sheet 10 may have two opposing long edges 55 substantially parallel to and on opposing sides of said axis 65 defining a width there between and two opposing short edges 60 substantially orthogonal to said axis 65 defining a length there between. In such an embodiment, the frangible boundary 30 may be along or coincident with an axis 65 substantially parallel to the long edges 55, as indicated in FIG. 1 by a thin dot dash line. The dryer sheet 10 may be folded along a first fold line 40 and a second fold line 45 substantially parallel to the first fold line 40 to have a z-fold. The dryer sheet 10 may be folded along a third fold line 50 substantially perpendicular to the first fold line 40 to have a c-fold. The first fold line 40, second fold line 45, and third fold line 50 are indicated in FIG. 1 by heavy dash-dot lines.

Figure 2:
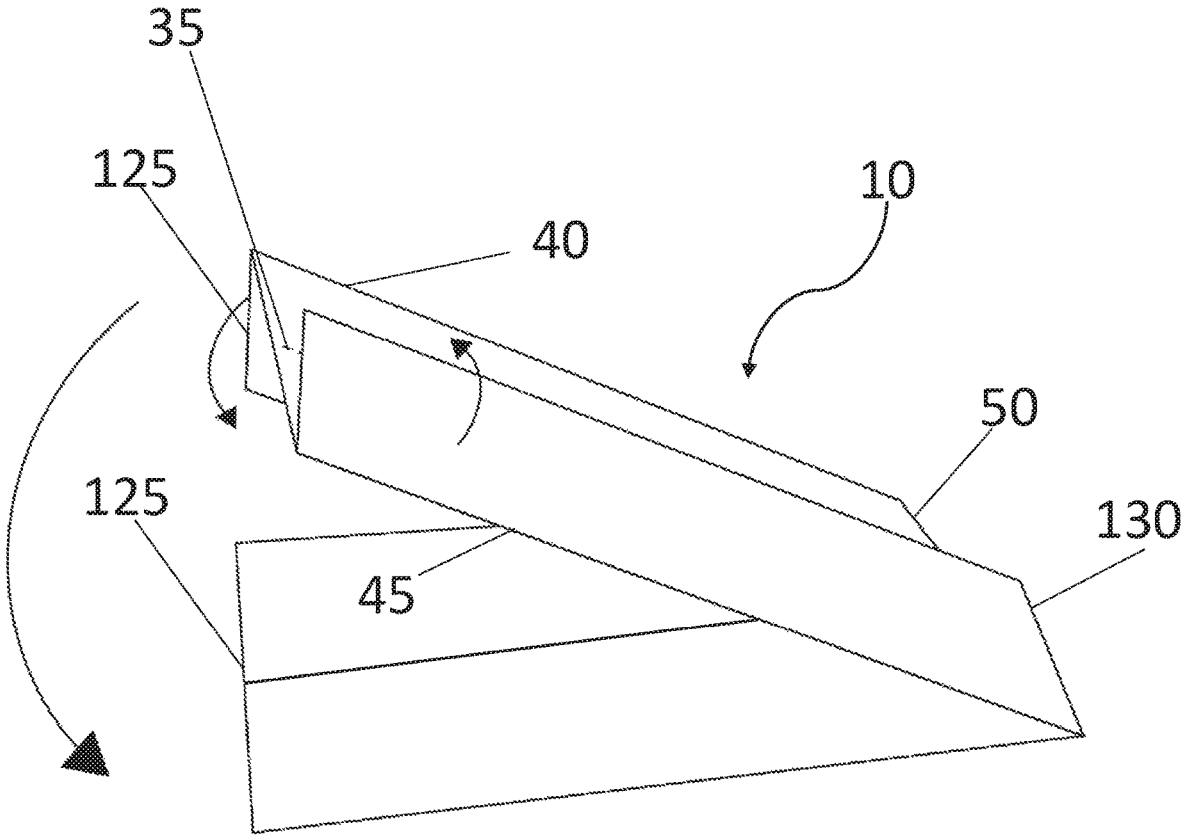
FIG. 2 is a perspective view of a folded discrete dryer sheet.

FIG. 2 is a one non-limiting embodiment of a folded discrete dryer sheet 10. The dryer sheet 10 may comprise a non-woven fibrous substrate 15. The dryer sheet 10 may be folded as indicated by the direction of the arrow along a first fold line 40 and further folded as indicated by the direction of the arrow along a second fold line 45 substantially parallel to the first fold line 40 to have a z-fold. In an embodiment, the dryer sheet 10 may be further folded as indicated by the direction of the arrow along a third fold line 50 substantially perpendicular to the first fold line 40 to have a c-fold. The dryer sheet 10 may be folded along a third fold line 50 substantially perpendicular to the first fold line 40 to have a c-fold, thereby creating a dryer sheet 10 driver end 130 at the third fold 50 and a dryer sheet 10 operator end 125. In an embodiment, the frangible boundary 30 may comprise a plurality of perforations 35, as indicated in FIG. 2 by a dashed line.

Figure 3:
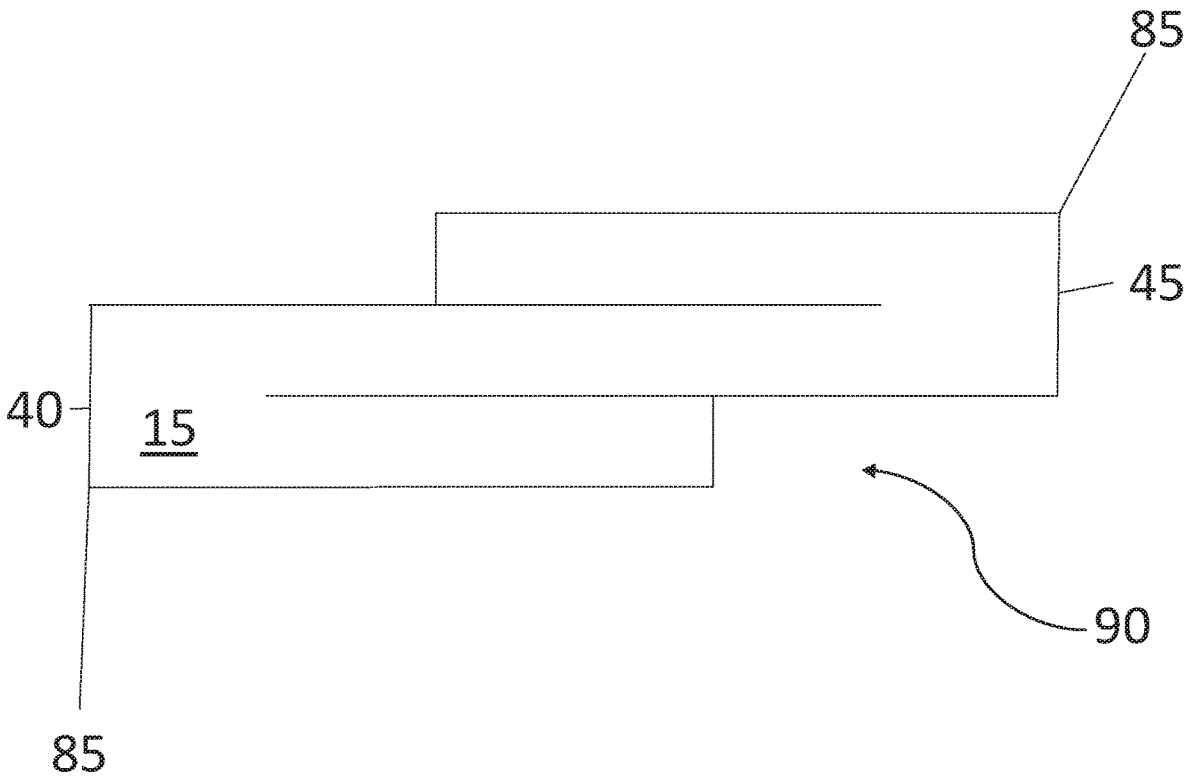
FIG. 3 is a side view of a dryer sheet having a z-fold.

FIG. 3 is a drawing of dryer sheet 10 having a z-fold 90. In an embodiment, the dryer sheet 10 may be folded along a first fold line 40 to be have a c-fold 85 along one portion of the dryer sheet 10. The dryer sheet 10 may further be folded along a second fold line 45 substantially parallel to the first fold line 40 to have a z-fold 90. In operation, a z-fold 90 is comprised of two c-folds 85.

Figure 4:
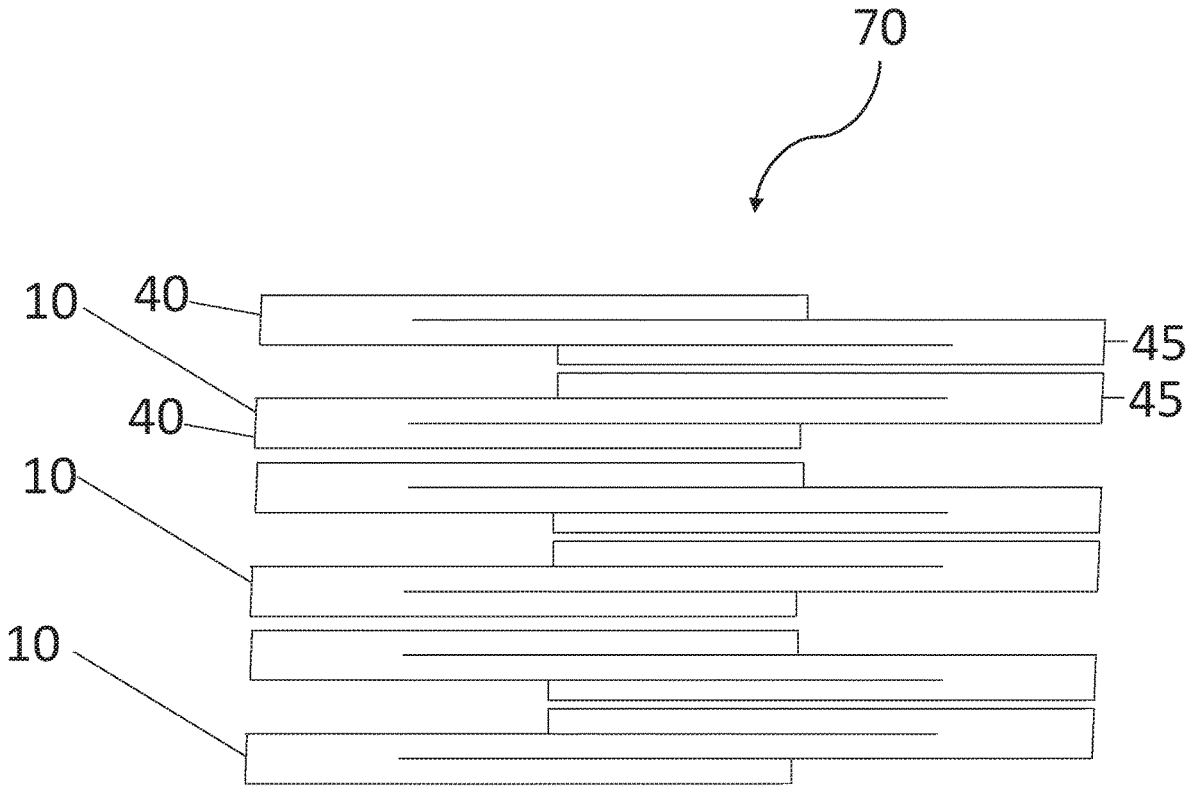
FIG. 4 is a side view of a stack of dryer sheets having z-folds.

FIG. 4 is a stack 70 of dryer sheets 10 each dryer sheet 10 having a z-fold 90. In an embodiment, the plurality of dryer sheets 10 may be in a stack 70. In an embodiment, the plurality of dryer sheets 10 may be in a stack 70 wherein each dryer sheet 10 is placed on top of, but is not interleaved, with the dryer sheet 10 immediately above and/or below. In an embodiment, the plurality of dryer sheets 10 may be in a stack 70 wherein each dryer sheet 10 is interleaved with the dryer sheet 10 immediately above and/or below. In an embodiment, the stack 70 of folded dryer sheets 10 may be vertically stacked, such that each dryer sheet 10 may lie on top of the dryer sheet 10 immediately below, as shown in FIG. 4. In an embodiment, the stack 70 of folded dryer sheets 10 may be horizontally stacked, such that each dryer sheet 10 may lie adjacent with the dryer sheet 10 immediately to the left and/or to the right.

Figure 5:
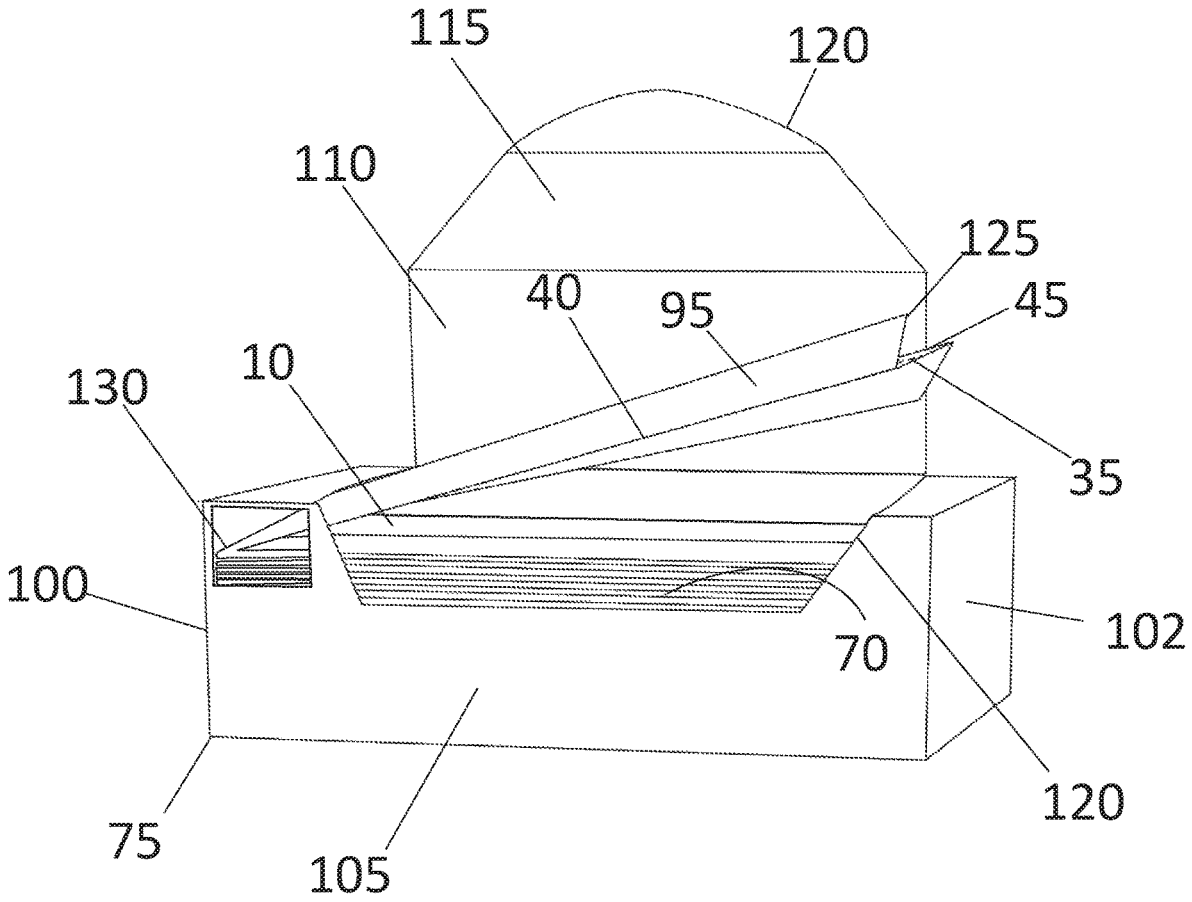
FIG. 5 is a perspective view of a plurality of discrete dryer sheets in a stack located within the interior of a carton.

FIG. 5 is a plurality of discrete dryer sheets 10 in a stack 70 located within the interior of a carton 75. In an embodiment, the dryer sheets 10 may be in an orientation within the carton 75 in which a consumer may curve her index finger under the top flap 95 and her thumb over the top flap 95 to pinch the top flap 95 of the dryer sheet 10 to easily pull the dryer sheet 10 out of the carton 75. The carton 75 may be in the shape of a rectangular or square box. The carton 75 may have a front panel 105 and an opposing back panel (not shown), a left side panel 100 and an opposing right side panel 102, a top panel 110 and an opposing bottom panel (not shown). The dryer sheet 10 may be in an orientation within the carton 75 in which the dryer sheet 10 driver end 130 may be adjacent to the left side panel 100 and the dryer sheet 10 operator side 125 may be adjacent to the right side panel 102. As illustrated in FIG. 5, a portion of the carton 75 has been removed to illustrate the location of the driver end 130 of each dryer sheet 10. The carton 75 may comprise a line of weakness 120 which allows for easy opening of the carton 75 to access the interior contents. In an embodiment, the line of weakness 120 comprises a plurality of slits or cuts into the carton 75. In an embodiment, the line of weakness 120 is formed from the top panel 110 and one or more side panels 100, 102 of the carton 75, as shown in FIG. 5. The two ends of the line of weakness 120 of the present invention may be connected by a hinge line to forms recloseable access flap 115.

Dryer Sheet

The dryer-activated product may comprise a plurality of discrete dryer sheets 10. The dryer sheets 10 may comprise a non-woven fibrous substrate 15. Each dryer sheet 10 may have at least a first portion 20, a second portion 25, and a frangible boundary 30 between the first portion 20 and the second portion 25. Each of the first portion 20 and the second portion 25 may comprise at least about 0.35 grams of a fabric conditioning active composition.

Substrate

The dryer sheet 10 may comprise a substrate 15. The dryer sheet 10 may comprise a fibrous substrate 15. In an embodiment, the dryer sheet 10 may comprise a non-woven fibrous substrate 15. Non-woven substrates 15 are defined by ISO standard 9092. The term "non-woven substrate" is used herein in the broadest sense and may mean a sheet of fibers, continuous filaments, or chopped yarns of any nature or origin, that have been formed into a web by any means, and bonded together by any means, with the exception of weaving or knitting. Non-woven substrates are distinguished from wet laid cellulosic paper substrates, such as absorbent paper substrates including, but not limited to, paper towels, toilet paper, and facial tissues comprised of greater than 50% fibers of vegetable origin.

In operation, any of the fabric conditioning active composition, perfume, optional ingredients, or combinations thereof, may be incorporated into or onto the substrate 15, thereby forming a dryer sheet 10. When the substrate 15 is placed inside the automatic laundry drying machine along with articles of clothing, and the automatic laundry drying machine is turned on, the rubbing of the dryer sheet 10 with the fabric caused by the rotation of the drum causes the fabric conditioning active composition, perfume, optional ingredients, or combinations thereof, to be transferred from the substrate 15 onto the fabric. The substrate may include but is not limited to those used in dryer sheets such as those sold under the tradename BOUNCE DRYER SHEETS manufactured and sold by The Procter & Gamble Company, Cincinnati, Ohio, USA and SNUGGLE DRYER SHEETS manufactured and sold by The Sun Products Corporation, Wilton, Conn., USA.

Fabric Conditioning Active Composition

The dryer sheet 10 may have at least a first portion 20 and a second portion 25 wherein each of the first portion 20 and the second portion 25 may comprise at least about 0.35 grams of a fabric conditioning active composition. The dryer sheet 10 may have at least a first portion 20 and a second portion 25 wherein each of the first portion 20 and the second portion 25 may comprise at least about 0.7 grams of a fabric conditioning active composition. The dryer sheet 10 may have at least a first portion 20 and a second portion 25 wherein each of the first portion 20 and the second portion 25 may comprise at least about 1 gram of a fabric conditioning active composition. The dryer sheet 10 may have at least a first portion 20 and a second portion 25 wherein each of the first portion 20 and the second portion 25 may comprise at least about 1.3 grams of a fabric conditioning active composition. Providing a greater quantity of fabric conditioning active composition may provide the benefit of imparting additional softness to the fabric. Providing a greater quantity of fabric conditioning active composition may also provide the benefit of further reduction of static cling.

The fabric conditioning active composition is a composition that comprises a fabric conditioning active. In an embodiment, the fabric conditioning active comprises a fabric softening active, wherein the fabric softening active is suitable for use in an automatic laundry drying machine. Non-limiting examples of fabric softening actives may include those described in U.S. Pat. Nos. 5,476,599 and 5,578,234. Dryer sheets containing fabric softener actives are generally described by U.S. Pat. Nos. 3,442,692; 3,686,025; 4,834,895; 5,041,230; 5,145,595; 5,470,492; 5,476,599; and 5,883,069.

In an embodiment, the fabric conditioning active is a cationic nitrogen-containing compound such as a quaternary ammonium compound having one or two straight-chain organic groups of at least 8 carbon atoms; preferably one or two such groups of from 12 to 22 carbon atoms and, alternatively ester and/or amide linked. Specific non-limiting examples of conditioning actives include the following: Di Tallow, Di Methyl Ammonium Methyl Sulfate, N,N-di(oleyi-oxy-ethyl)-N,N-dimethyl ammonium chloride, N,N-di(canolyl-oxy-ethyl)-N,N-dimethyl ammonium chloride, N,N-di(oleyl-oxy-ethyl)-N-methyl, N-(2-hydroxyethyl) ammonium methyl sulfate, N,N-di(canolyl-oxy-ethyl)-N-methyl, N-(2-hydroxyethyl) ammonium methyl sulfate-, N,N-di(oleylamidoethyl)-N-methyl, N-(2-hydroxyethyl) ammonium methyl sulfate, N,N-di(2-oleyloxy oxo-ethyl)-N,N-dimethyl ammonium chloride, N,N-di(2-canolyloxy oxo-ethyl)-N,N-dimethyl ammonium chloride-, N,N-di(2-oleyloxyethylcarbonyloxyethyl)-N,N-dimethyl ammonium chloride, N,N-di(2-canolyloxyethylcarbonyloxyethyl)-N,N-dimethyl ammonium chloride, N-(2-oleyloxy ethyl)-N-(2-oleyloxy oxo-ethyl)-N,N-dimethyl ammonium chloride; N-(2-canolyloxy ethyl)-N-(2-canolyloxy oxo-ethyl)-N,N-dimethyl ammonium chloride, N,N,N-tri(oleyl-oxy-ethyl)-N-methyl ammonium chloride, N,N,N-tri(canolyi-oxy-ethyl)-N-methyl ammonium chloride-, N-(2-oleyloxy oxoethyl)-N-(oleyl)-N,N-dimethyl ammonium chloride, N-(2-canolyloxy oxoethyl)-N-(canolyl)-N, N-dimethyl ammonium chloride, 1,2-dioleyloxy N,N,N-trimethylammoniopropane chloride, and 5,2-dicanolyloxy N,N,N-trimethylammoniopropane chloride, and combinations thereof. In one embodiment, the fabric conditioning active is N,N-di(tallowyl-oxy-ethyl)-N-methyl, N-(2-hydroxyethyl) ammonium methyl sulfate.

The fabric conditioning active may include ingredients such as a nonionic material. Suitable nonionic materials may include polyoxyalkylene glycols, higher fatty alcohol esters of polyoxyalkylene glycols, higher fatty alcohol esters of polyoxyalkylene glycols, ethoxylates of long chained alcohols of from 8 to 30 carbon atoms such as the ethoxylates of coconut, palm, tallow alcohols or hydrogenated alcohols with 4 to 40 moles of ethylene oxide, and alkanolamides. The fabric conditioning actives may further comprise, with or without a non-ionic material, fatty acids, ethoxylated fatty acids, and combinations thereof. Preferred fatty acids are those wherein the long chain is unsubstituted or substituted alkyl or alkenyl group of from about 8 to 30 carbon atoms. Examples of specific fatty acids are lauric, palmitic, stearic, oleic, and/or combinations thereof. The fabric conditioning active may include other ingredients such as those described in U.S. Pat. Nos. 5,476,599 and 5,578,234. The fabric conditioning active may include but are not limited to those used in dryer sheets such as those sold under the tradename BOUNCE DRYER SHEETS manufactured and sold by The Procter & Gamble Company, Cincinnati, Ohio, USA and SNUGGLE DRYER SHEETS manufactured and sold by The Sun Products Corporation, Wilton, Conn., USA.

Perfume

The dryer sheet 10 may have at least a first portion 20 and a second portion 25 wherein each of the first portion 20 and the second portion 25 may comprise at least about 0.013 grams of a perfume. Each of the first portion 20 and the second portion 25 may comprise at least about 0.01 grams of an unencapsulated perfume. Each of the first portion 20 and the second portion 25 may comprise at least about 0.003 grams of an encapsulated perfume. Dryer sheets 10 often contain perfume to provide an olfactory aesthetic benefit and/or to serve as a signal that the dryer sheet 10 is effective.

The dryer sheet 10 may have at least a first portion 20 and a second portion 25 wherein each of the first portion 20 and the second portion 25 may comprise at least about 0.026 grams of a perfume. Each of the first portion 20 and the second portion 25 may comprise at least about 0.02 grams of an unencapsulated perfume. Each of the first portion 20 and the second portion 25 may comprise at least about 0.006 grams of an encapsulated perfume.

The dryer sheet 10 may have at least a first portion 20 and a second portion 25 wherein each of the first portion 20 and the second portion 25 may comprise at least about 0.112 grams of a perfume. Each of the first portion 20 and the second portion 25 may comprise at least about 0.09 grams of an unencapsulated perfume. Each of the first portion 20 and the second portion 25 may comprise at least about 0.022 grams of an encapsulated perfume. Providing a greater quantity of perfume may provide the benefit of additional fresh smell.

The dryer sheet 10 may have at least a first portion 20 and a second portion 25 wherein each of the first portion 20 and the second portion 25 is free or substantially free of a perfume.

The perfume ingredients of the present invention are the conventional ingredients known to one skilled in the art. The perfume ingredients of the present invention may be incorporated into the dryer sheet 10 as an unencapsulated free perfume oil, or neat perfume. The perfume ingredients of the present invention may be incorporated into the dryer sheet 10 as a perfume encapsulated into a microcapsule to form a perfume microcapsule, or encapsulated perfume.

The term "unencapsulated perfume" is used herein in the broadest sense and may mean a composition comprising free perfume ingredients wherein the free perfume ingredients are neither absorbed onto or into a perfume carrier (e.g., absorbed on to zeolites or clays or cyclodextrin) nor encapsulated (e.g., in a perfume microcapsule, or encapsulated). An unencapsulated perfume ingredient may also comprise a pro-perfume, provided that the pro-perfume is neither absorbed nor encapsulated. Non-limiting examples of suitable perfumes ingredients include blooming perfumes, perfume oils, and perfume raw materials comprising alcohols, ketones, aldehydes, esters, ethers, nitriles alkenes, and mixtures thereof. Non-limiting examples of blooming perfume ingredients that may be useful in the products of the present invention are given in U.S. Patent Publication 2005/

0192207 A1. The dryer sheet 10 may have at least a first portion 20 and a second portion 25 wherein each of the first portion 20 and the second portion 25 is free or substantially free of an unencapsulated perfume.

The term "encapsulated perfume" is used herein in the broadest sense and may include the encapsulation of perfume or other materials or actives in small capsules (i.e., microcapsules), typically having a diameter less than about 300 microns. These microcapsules may comprise a spherical hollow shell of water insoluble or at least partially water insoluble material, typically polymer material, within which the active material, such as perfume, is contained. The shell of the microcapsule may comprise an aminoplast resin. Aminoplast resins are the reaction products of one or more amines with one or more aldehydes, typically formaldehyde. Non-limiting examples of suitable amines include urea, thiourea, melamine and its derivatives, benzoguanamine and acetoguanamine and combinations of amines. Suitable cross-linking agents (e.g., toluene diisocyanate, divinyl benzene, butane diol diacrylate etc.) may also be used and secondary wall polymers may also be used as appropriate, e.g., anhydrides and their derivatives, particularly polymers and co-polymers of maleic anhydride as disclosed in U.S. Patent Publication 2004/0087477 A1. The shell of the microcapsule may comprise urea-formaldehyde, melamine-formaldehyde, or combinations thereof.

The encapsulated perfume may comprise a friable perfume microcapsule. Friability refers to the propensity of the microcapsule to rupture or break open when subjected to direct external pressures or shear forces. As disclosed herein, a microcapsule is "friable" if, while attached to fabrics treated therewith, the microcapsule can be ruptured by the forces encountered when the capsule-containing fabrics are manipulated by being worn or handled (thereby releasing the contents of the capsule). Friable perfume microcapsules can be attractive for use in dryer-activated products because not only do the friable perfume microcapsules enable top-note scent characters to deposit easily onto fabrics after the drying process, but they also allow the consumer to experience these scent types throughout the day while wearing their article of clothing. Friable perfume microcapsules rupture and release perfume by a mechanical means (e.g., friction), not a chemical means (e.g., water hydrolysis). Minimal fracture pressure is typically needed to break the structure such as normal everyday physical movements such as taking off a jacket; pulling a shirt off; or taking off/putting on socks. Non-limiting examples of perfume microcapsules suitable as an encapsulated perfume are available in the following references: U.S. Pat. Nos. 6,645,479; 6,200,949; 4,882,220; 4,917,920; 4,514,461; 4,234,627; 2003/215417 A1; 2003/216488 A1; 2003/158344 A1; 2003/165692 A1; 2004/071742 A1; 2004/071746 A1; 2004/072719 A1; 2004/072720 A1; 2003/203829 A1; 2003/195133 A1; 2004/087477 A1; 2004/0106536 A1 and EP Patent Publication 1393706 A1. The perfume microcapsule may encapsulate a blooming perfume composition, wherein the blooming perfume composition comprises blooming perfume ingredients. A non-limiting example of suitable dryer sheets 10 comprising a perfume microcapsule is disclosed in U.S. Pat. No. 5,425,887. The dryer sheet 10 may have at least a first portion 20 and a second portion 25 wherein each of the first portion 20 and the second portion 25 is free or substantially free of an encapsulated perfume. The first portion 20 and second portion 25 may comprise at least about 0.022 grams of an encapsulated perfume, wherein the encapsulated perfume comprises a friable perfume microcapsule. The dryer sheet 10 may have at least a first portion 20 and a second portion 25 wherein each of the first portion 20 and the second portion 25 is free or substantially free of a friable perfume microcapsule.

The encapsulated perfume may comprise a moisture-activated microcapsule, such as those microcapsules wherein the shell of the microcapsule comprises cyclodextrin. In an embodiment, the encapsulated perfume may comprise a moisture-activated microcapsule comprising one or more free perfume ingredients either absorbed onto or into a perfume carrier (e.g., zeolites, clays, cyclodextrin, and combinations thereof). In an embodiment, the encapsulated perfume may comprise a moisture-activated microcapsule comprising a cyclodextrin carrier such as beta-cyclodextrin. The first portion 20 and second portion 25 may comprise at least about 0.022 grams of an encapsulated perfume, wherein the encapsulated perfume comprises a moisture-activated microcapsule. The dryer sheet 10 may have at least a first portion 20 and a second portion 25 wherein each of the first portion 20 and the second portion 25 is free of a moisture-activated microcapsule. The first portion 20 and second portion 25 may comprise at least about 0.022 grams of an encapsulated perfume, wherein the encapsulated perfume comprises a friable perfume microcapsule and a moisture-activated microcapsule.

The encapsulated perfume may comprise a heat-activated microcapsule. As defined herein, a heat-activated microcapsule is one that ruptures or otherwise releases the encapsulated composition by body heat and/or by the heat in a machine dryer. In an embodiment, the encapsulated perfume comprises a friable perfume microcapsule, a moisture-activated microcapsule, a heat-activated microcapsule, and combinations thereof. Non-limiting examples of additional microcapsules include wax microcapsule such as those described in U.S. Pat. No. 5,246,603 and starch-based microcapsule also described in U.S. Pat. No. 5,246,603.

The unencapsulated perfume, encapsulated perfume, or combination thereof, may be incorporated into the dryer sheet 10 by adding it to the fabric conditioning active composition before the fabric conditioning active composition is added to the non-woven fibrous substrate 15 of the dryer sheet 10. The unencapsulated perfume, encapsulated perfume, or combinations thereof, may be coated on the non-woven fibrous substrate 15 of the dryer sheet 10 by spraying means, wherein the substrate 15 may or may not comprise a fabric conditioning active composition.

Optional Ingredients

The dryer sheet 10 may comprise additional optional ingredients. As used herein, an optional ingredient means any material that performs a function or delivers a benefit, such as modifying the physical or chemical properties of the treated material (e.g., fabric).

Suitable optional ingredients may include, but are not limited to: perfumes, softening agents, soil release agents, anti-static agents, crisping agents, water/stain repellents, stain release agents, refreshing agents, disinfecting agents, wrinkle resistant agents, wrinkle release agents, odor resistance agents, malodor control agents, abrasion resistance and protection agents, solvents, insect/pet repellents, wetting agents, chlorine scavenging agents, optical brighteners, UV protection agents, skin/fabric conditioning agents, skin/fabric nurturing agents, skin/fabric hydrating agents, color protection agents, dye fixatives, dye transfer inhibiting agents, silicones, preservatives and anti-microbials, fungicides, fabric shrinkage-reducing agents, brighteners, hueing dyes, bleaches, chelants, antifoams, anti-scum agents, whitening agents, catalysts, cyclodextrin, zeolite, petrolatum, glycerin, triglycerides, vitamins, other skin care actives such as aloe vera, chamomile, shea butter and the like, mineral oils, and combinations thereof. In an embodiment, the dryer sheet 10 may comprise one or more optional ingredients as unencapsulated ingredients. In an embodiment, the dryer sheet 10 may comprise one or more optional ingredients wherein the optional ingredients may be encapsulated in microcapsules. In an embodiment, the dryer sheet 10 may comprise odor control agents (such as cyclodextrin, metal salts, and zeolites), wrinkle control agents, antimicrobial agents, fungicides, preservatives, insect repellents, or combinations thereof. In an embodiment, the dryer sheet 10 may be free or substantially free of one more of the above identified optional ingredients.

Configuration of Dryer Sheet

Frangible Boundary

Each dryer sheet 10 may have at least a first portion 20, a second portion 25, and a frangible boundary 30 between the first portion 20 and the second portion 25. As used herein, the frangible boundary 30 is a weakened boundary where consumers may separate the dryer sheet 10 into the first portion 20 and the second portion 25 by placing tension on the frangible boundary 30 such that the first portion 20 becomes detached from the second portion 25 along the frangible boundary 30. The frangible boundary 30 may comprise a plurality of perforations 35. In an embodiment, the frangible boundary 30 may comprise a row of perforations 35. Alternatively, the frangible boundary 30 may comprise a plurality of cuts, wherein parts of the substrate 15 are not removed by the cuts. Alternatively, the frangible boundary 30 may comprise a plurality of apertures or punch out perforations 35, wherein some parts of the substrate 15 are removed where the apertures or perforations 35 are placed. Having a first portion 20 and a second portion 25 able to be detached from one another by a frangible boundary 30 may allow for consumers to choose between using an entire dryer sheet 10 or using one portion of a dryer sheet 10, depending on the size of the load in the automatic laundry drying machine.

The frangible boundary 30 may comprise a row of perforations 35. Having a row, or a line, of perforations 35 may allow the consumer to more easily pull apart the dryer sheet 10. The frangible boundary 30 may be located centrally on the dryer sheet 10. In an embodiment, the dryer sheet 10 may be substantially rectangularly shaped. The dryer sheet 10 may have two opposing long edges 55 substantially parallel to and on opposing sides of said axis 65 defining a width there between and two opposing short edges 60 substantially orthogonal to said axis 65 defining a length there between. A rectangularly shaped dryer sheet 10 is familiar to consumers and is convenient to organize when storing a plurality of dryer sheets 10. The frangible boundary 30 may be along or coincident with an axis 65 substantially parallel to the long edges 55. As a general habit of holding substantially rectangularly shaped books and sheets by the two long edges 55 so that the length is vertical to the consumer, having the frangible boundary 30 along or coincident with an axis 65 substantially parallel to the long edges 55 can provide the benefit that consumers will not have to change this habit to separate the first portion 20 from the second portion 25 of the dryer sheet 10 because the dryer sheet 10 will unfold so that the long edges 55 are vertical to the consumer. Alternatively, the frangible boundary 30 may be substantially parallel to the short edges 60. Having the frangible boundary 30 substantially parallel to the short edges 60 may provide the benefit of a shorter length to apply tension to when detaching the first portion 20 from the second portion 25. The dryer sheet 10 may have more than one frangible boundary 30. The dryer sheet 10 may be substantially rectangularly shaped as shown in FIG. 1, however, one of skill in the art will recognize that the shape of the dryer sheet 10 is not so limited. Other suitable dryer sheet 10 shapes may include but are not limited to substantially squared, substantially circular, and substantially triangular.

Folding

The dryer sheet 10 may be folded. Folding enables the dryer sheet 10 to take up less planar space in a consumer's storage area. The dryer sheet 10 may be folded along a first fold line 40 to have a c-fold 85. The dryer sheet 10 may be folded along a second fold line 45 substantially parallel to the first fold line 40 to have a z-fold 90. The dryer sheet 10 may be folded along a second fold line 45 not substantially parallel to the first fold line 40. In operation, a z-fold 90 is comprised of two c-folds 85, as shown in FIG. 3. In an embodiment, each c-fold 85 is along a portion of the dryer sheet 10. The dryer sheet 10 may be folded along a third fold line 50 substantially perpendicular to the first fold line 40 to have a c-fold 85. The dryer sheet 10 may be folded along a third fold line 50 substantially perpendicular to the second fold line 45. In an embodiment, the dryer sheet 10 may be folded in half along a third fold line 50 substantially perpendicular to the first fold line 40 to have a c-fold 85. The dryer sheet 10 may first be folded as indicated by the direction of the arrow in FIG. 2 along the first fold line 40 and further folded as indicated by the direction of the arrow in FIG. 2 along the second fold line 45 to have a z-fold 90 as shown in FIGS. 2 and 3. The dryer sheet 10 having a z-fold 90 may then be folded as indicated by the direction of the arrow in FIG. 2. along a third fold line 50 to have a c-fold 85. Alternatively, the dryer sheet 10 may first be folded along the third fold line 50 to have a c-fold 85. The dryer sheet 10 having a c-fold 85 may then be folded along the first fold line 40 and further folded along the second fold line 45 to have a z-fold 90. This alternative embodiment provides the benefit of the consumer being able to see the frangible boundary 30 when the dryer sheet 10 is folded. The dryer sheet 10 may be folded along a third fold line 50 substantially perpendicular to the first fold line 40 to have a c-fold 85, thereby creating a dryer sheet 10 driver end 130 at the third fold 50 and a dryer sheet 10 operator end 125, as shown in FIGS. 2 and 5.

However, one of skill in the art will recognize that the folding of the dryer sheet 10 is not so limited. The dryer sheet 10 may be folded along any one of the first fold line 40, the second fold line 45, the third fold line 50, and combinations thereof, to have a c-fold, a tri-fold, a z-fold, a double parallel fold, a roll fold, a double gate fold, a 3-panel gate fold, and any combinations thereof.

In an embodiment, the dryer sheet 10 may first be folded along a first fold line 40 and along a second fold line 45 substantially parallel to the first fold line 40 to have a z-fold 90. The first fold line 40 and second fold line 45 may be substantially parallel to the frangible boundary 30. The first fold line 40 and the second fold line 45 may be along or coincident with an axis 65 substantially parallel to the long edges 55 of the dryer sheet 10. The dryer sheet 10 may then be folded along a third fold line 50 substantially perpendicular to the first fold line 40 to have a c-fold 85. In such an embodiment, the dryer sheet 10 can use less planar space in a consumer's storage area and can provide the benefit of a consumer easily picking up the dryer sheet 10 by one of the long edges 55. The dryer sheet 10 may then easily be retrieved from a carton 75 and unfolded by first unfolding the dryer sheet 10 along the third fold line 50 to remove the c-fold 85. The dryer sheet 10 may then be further unfolded by unfolding the dryer sheet 10 along the second fold line 45 and along the first fold line 40 to remove the z-fold 90 to have an unfolded dryer sheet 10 as shown in FIG. 1. The dryer sheet 10 may then be separated by placing tension on the frangible boundary 30 such that the first portion 20 becomes detached from the second portion 25 along the frangible boundary 30. Alternatively, the dryer sheet 10 may be left with the first portion 20 and the second portion 25 attached to one another. By folding the dryer sheet 10 first to have a z-fold 90 and then folding the folded dryer sheet 10 to have a c-fold 85, as shown in FIG. 2, the frangible boundary 30 can be protected from separating prematurely in handling.

In an embodiment, the dryer sheet 10 may be folded along the frangible boundary 30 to have a c-fold 85. In an embodiment, the dryer sheet 10 may not be folded.

Plurality of Dryer Sheets

The plurality of discrete dryer sheets 10 may be in a stack 70. In an embodiment, at least one dryer sheet 10 may be within the interior of a carton 75.

In an embodiment, the plurality of dryer sheets 10 may be in a stack 70. In an embodiment, the plurality of dryer sheets 10 may be in a stack 70 wherein each dryer sheet 10 is placed on top of, but is not interleaved, with the dryer sheet 10 immediately above and/or below. In an embodiment, the plurality of dryer sheets 10 may be in a stack 70 wherein each dryer sheet 10 is interleaved with the dryer sheet 10 immediately above and/or below. In an embodiment, the stack 70 of folded dryer sheets 10 may be vertically stacked, such that each dryer sheet 10 may lie on top of the dryer sheet 10 immediately below.

In an embodiment where the plurality of discrete dryer sheets 10 are first folded to have a z-fold 90 and then folded to have a c-fold 85 such as that shown in FIG. 2, the stack 70 of folded dryer sheets 10 may be vertically stacked, as shown in FIGS. 4 and 5, such that each dryer sheet 10 may lie on top of the dryer sheet 10 immediately below. As shown in FIG. 5, the dryer sheets 10 may be in an orientation within the carton 75 in which a consumer may curve her index finger under the top flap 95 and her thumb over the top flap 95 to pinch the top flap 95 of the dryer sheet 10 to easily pull the dryer sheet 10 out of the carton 75.

The carton 75 may be in the shape of a rectangular or square box. The carton 75 may have sharp angular edges or smoothed edges. Suitable carton materials may include cardboard and or paper materials and are commonly known and used for storing dryer sheets 10. Depending upon the number of dryer sheets 10 to be stored within the carton 75 and the dryer sheet 10 dimensions, the carton 75 can have varying dimensions. Non-limiting examples of suitable carton dimensions are described in U.S. Pat. No. 5,310,057. The carton 75 may have a front panel 105 and an opposing back panel, a left side panel 100 and an opposing right side panel 102, a top panel 110 and an opposing bottom panel. The carton 75 may comprise a line of weakness 120 which allows for easy opening of the carton 75 to access the interior contents. In an embodiment, the line of weakness 120 comprises a plurality of slits or cuts into the carton 75. In an embodiment, the line of weakness 120 is formed from the top panel 110 and one or more side panels 100, 102 of the carton 75. In an embodiment, the line of weakness 120 is formed only of the top panel 110. In yet another embodiment, the line of weakness 120 is formed only of one or more of the side panels 100, 102. It should be understood that the line of weakness 120 can be formed in any one or more adjacent panels such that a recloseable access flap 115 is formed from the portion of the panel(s) which form the line of weakness 120. The two ends of the line of weakness 120 of the present invention may be connected by a hinge line to forms recloseable access flap 115. The hinge line may allow the recloseable access flap 115 to be biased away from the carton 75 such that the interior contents of the carton 75 can be accessed. Examples of cartons may include but are not limited to cartons such as those sold under the tradename BOUNCE DRYER SHEETS manufactured and sold by The Procter & Gamble Company, Cincinnati, Ohio, USA and SNUGGLE DRYER SHEETS manufactured and sold by The Sun Products Corporation, Wilton, Conn., USA. In an embodiment as shown in FIG. 5, the dryer sheet 10 may be in an orientation within the carton 75 in which the dryer sheet 10 driver end 130 may be adjacent to the left side panel 100 and the dryer sheet 10 operator side 125 may be adjacent to the right side panel 102. In an alternative embodiment, the dryer sheet 10 may be in an orientation within the carton 75 in which the dryer sheet 10 driver end 130 may be adjacent to the right side panel 102 and the dryer sheet 10 operator side 125 may be adjacent to the left side panel 100. As illustrated in FIG. 5, a portion of the carton 75 has been removed to illustrate the location of the driver end 130 of each dryer sheet 10.

Process

A process for conditioning fabrics can be as set forth herein. The process for conditioning fabrics can comprise the steps of grasping a discrete dryer sheet 10 having a frangible boundary, tearing the dryer sheet 10 along the frangible boundary 30 into a first portion 20 and a second portion 25, placing one or both of the first portion 20 and second portion 25 inside an automatic laundry drying machine containing articles of clothing, and turning on the automatic laundry machine. The dryer sheet 10 may be pulled from a carton 75 where the dryer sheet 10 is in a stack 70. The dryer sheet 10 may be placed inside the automatic laundry drying machine without tearing the dryer sheet 10 along the frangible boundary 30 if the laundry load fills more than half of the drum of the automatic laundry drying machine. Either the first portion 20 or the second portion 25 may be placed without the other portion inside the automatic laundry drying machine if the laundry load fills less than half of the drum. Placing both the first portion 20 and the second portion 25 inside the automatic laundry drying machine when the laundry load fills more than half of the drum can provide the benefit of more of the individual pieces of clothing in this larger sized load acquiring more of the fabric conditioning active composition, perfume, and/or optional ingredients because there is a greater quantity of fabric conditioning active composition, perfume, and/or optional ingredients available to be dispersed. Having the full dryer sheet 10, or a portion of the dryer sheet 10, depending on the quantity of clothing in the laundry load, may allow for more accurate dosing of the fabric conditioning active composition, perfume, and/or optional ingredients, and may lead to less situations of underdosing. A more accurate dosing of the fabric conditioning active composition, perfume, and/or optional ingredients may result in the benefits of softer, fresher smelling clothing, with less static cling.

Examples/Combinations

A. A dryer-activated product comprising a plurality of discrete dryer sheets 10, said dryer sheets comprising a non-woven fibrous substrate 15, each said dryer sheet having at least a first portion 20, a second portion 25, and a frangible boundary 30 between said first portion and said second portion, wherein each of said first portion and said second portion comprises at least about 0.35 grams of a fabric conditioning active composition, preferably at least about 0.7 grams of a fabric conditioning active composition, more preferably at least about 1 gram of a fabric conditioning active composition, most preferably at least about 1.3 grams of a fabric conditioning active composition.

B. The dryer-activated product according to paragraph A, wherein said frangible boundary comprises a plurality of perforations 35.

C. The dryer-activated product according to paragraph A or B, wherein each said dryer sheet is folded along a first fold line 40 to have a c-fold 85.

D. The dryer-activated product according to any one of paragraphs A to C, wherein each said dryer sheet is folded along a second fold line 45 substantially parallel to said first fold line to have a z-fold 90.

E. The dryer-activated product according to any one of paragraphs A to D, wherein each said dryer sheet is folded along a third fold 50 line substantially perpendicular to said first fold line.

F. The dryer-activated product according to any one of paragraphs A to E, wherein each said dryer sheet is substantially rectangularly shaped.

G. The dryer-activated product according to any one of paragraphs A to F, wherein said dryer sheet has an axis 65 and wherein said dryer sheet comprises two opposing long edges 55 substantially parallel to and on opposing sides of said axis defining a width there between and two opposing short edges 60 substantially orthogonal to said axis defining a length there between, wherein said frangible boundary is along said axis substantially parallel to said long edges.

H. The dryer-activated product according to any one of paragraphs A to F, wherein said dryer sheet has an axis and wherein said dryer sheet comprises two opposing long edges substantially parallel to and on opposing sides of said axis defining a width there between and two opposing short edges substantially orthogonal to said axis defining a length there between, wherein said frangible boundary is substantially parallel to said short edges.

I. The dryer-activated product according to any one of paragraphs A to H, wherein said plurality of discrete dryer sheets are in a stack 70.

J. The dryer-activated product according to any one of paragraphs A to I, wherein said plurality of discrete dryer sheets are in a stack within the interior of a carton 75.

K. The dryer-activated product according to any one of paragraphs A to J, wherein each of said first portion and said second portion comprises at least about 0.013 grams of a perfume, more preferably at least about 0.026 grams of a perfume, most preferably at least about 0.112 grams of a perfume.

L. The dryer-activated product according to any one of paragraphs A to K, wherein each of said first portion and said second portion comprises at least about 0.01 grams of an unencapsulated perfume, more preferably at least about 0.02 grams of an unencapsulated perfume, most preferably at least about 0.09 grams of an unencapsulated perfume.

M. The dryer-activated product according to any one of paragraphs A to L, wherein each of said first portion and said second portion comprises at least about 0.003 grams of an encapsulated perfume, more preferably at least about 0.006 grams of an encapsulated perfume, most preferably at least about 0.022 grams of an encapsulated perfume.

N. A process for conditioning fabrics using the dryer-activated product according to any one of paragraphs A to M comprising the steps of providing the dryer-activated product according to paragraph A, grasping said discrete dryer sheet, tearing said dryer sheet along said frangible boundary into said first portion and said second portion, placing one or both of said first portion and said second portion inside an automatic laundry drying machine containing articles of clothing, and turning on said automatic laundry drying machine.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dryer-activated product comprising a plurality of discrete dryer sheets, said dryer sheets comprising a non-woven fibrous substrate, wherein each said dryer sheet is folded along a first fold line and along a second fold line substantially parallel to said first fold line to have a z-fold, wherein each said dryer sheet is folded along a third fold line substantially perpendicular to said first fold line to have a c-fold, each said dryer sheet having at least a first portion, a second portion, and a frangible boundary between said first portion and said second portion, wherein said frangible boundary comprises a plurality of perforations, wherein said frangible boundary is at least partially overlapped by a portion of the non-woven fibrous substrate when in said z-fold, wherein each of said first portion and said second portion comprises at least about 0.35 grams of a fabric conditioning active composition.

2. The dryer-activated product of claim 1, wherein each of said first portion and said second portion comprises at least about 0.013 grams of a perfume.

3. The dryer-activated product of claim 2, wherein each of said first portion and said second portion comprises at least about 0.01 grams of an unencapsulated perfume.

4. The dryer-activated product of claim 1, wherein each said dryer sheet is substantially rectangularly shaped.

5. The dryer-activated product of claim 4, wherein said dryer sheet has an axis and wherein said dryer sheet comprises two opposing long edges substantially parallel to and on opposing sides of said axis defining a width there between and two opposing short edges substantially orthogonal to said axis defining a length there between, wherein said frangible boundary is along said axis substantially parallel to said long edges.

6. The dryer-activated product of claim 4, wherein said dryer sheet has an axis and wherein said dryer sheet comprises two opposing long edges substantially parallel to and on opposing sides of said axis defining a width there between and two opposing short edges substantially orthogonal to said axis defining a length there between, wherein said frangible boundary is substantially parallel to said short edges.

7. The dryer-activated product of claim 5, wherein said plurality of discrete dryer sheets are in a stack.

8. The dryer-activated product of claim 1, wherein each of said first portion and said second portion comprises at least about 0.01 grams of an unencapsulated perfume.

9. The dryer-activated product of claim 1, wherein said plurality of discrete dryer sheets are in a stack.

* * * * *